US011413201B2

(12) United States Patent
Zeng

(10) Patent No.: US 11,413,201 B2
(45) Date of Patent: Aug. 16, 2022

(54) ELECTRIC BED

(71) Applicant: Guohong Zeng, Qingyuan (CN)

(72) Inventor: Guohong Zeng, Qingyuan (CN)

( * ) Notice: Subject to any disclaimer, the term of this patent is extended or adjusted under 35 U.S.C. 154(b) by 259 days.

(21) Appl. No.: 16/701,181

(22) Filed: Dec. 3, 2019

(65) Prior Publication Data

US 2020/0100961 A1 Apr. 2, 2020

(30) Foreign Application Priority Data

Nov. 25, 2019 (CN) ..... 201911163833.9
Nov. 25, 2019 (CN) ..... 201922049852.0

(51) Int. Cl.
*A61G 7/015* (2006.01)
*A61G 7/018* (2006.01)
*A47C 19/02* (2006.01)

(52) U.S. Cl.
CPC ..... *A61G 7/015* (2013.01); *A47C 19/021* (2013.01); *A61G 7/018* (2013.01)

(58) Field of Classification Search
CPC ..... A61G 7/015; A61G 7/018; A61G 7/16; A47C 19/021
See application file for complete search history.

(56) References Cited

U.S. PATENT DOCUMENTS 4,862,529 A * 9/1989 Peck ..... A61G 7/015 5/611
D758,090 S * 6/2016 Shih ..... D6/392
9,795,223 B1 * 10/2017 Shih ..... A47C 19/021
10,299,976 B2 * 5/2019 Lo ..... A61G 7/015
2013/0212807 A1 * 8/2013 Manson ..... A61G 7/16 5/618
2015/0107023 A1 * 4/2015 Huang ..... A61G 7/015 5/614
2016/0022518 A1 * 1/2016 Shih ..... A61G 7/018 5/616
2017/0027333 A1 * 2/2017 Shih ..... A61G 7/015
2017/0087039 A1 * 3/2017 Shih ..... A61G 7/018
2017/0252244 A1 * 9/2017 Zhou ..... A47C 20/08
2017/0360209 A1 * 12/2017 Zhou ..... A61G 7/1074
2018/0008049 A1 * 1/2018 Shih ..... A47C 19/021
2018/0064259 A1 * 3/2018 Shih ..... A47C 20/041
2018/0064260 A1 * 3/2018 Shih ..... A47C 21/02
2018/0338724 A1 * 11/2018 Shan ..... A61B 5/746
2019/0000238 A1 * 1/2019 Eskridge, III ..... A61G 7/0755
2019/0021511 A1 * 1/2019 Shih ..... A47C 20/08
2019/0191890 A1 * 6/2019 Huang ..... A47C 20/08
(Continued)

*Primary Examiner* — Eric J Kurilla

(57) ABSTRACT

An electric bed comprises a main bed frame and a movable auxiliary bed frame, wherein the auxiliary bed frame is sequentially provided with a bottom plate, a base plate and a backing plate, the front end of the base plate is rotatably connected to the front end of the auxiliary bed frame, the rear end of the bottom plate is rotatably connected to the front end of the base plate, the front end of the backing plate is rotatably connected to the rear end of the base plate, a first electric telescopic rod and a second electric telescopic rod for driving the bottom plate and the backing plate to be unfolded and stored are provided between the bottom plate and the main bed frame and between the backing plate and the auxiliary bed frame, respectively, and a linkage member is provided between the bottom plate and the main bed frame.

9 Claims, 7 Drawing Sheets

(56) References Cited

U.S. PATENT DOCUMENTS

| | | | | |
|---|---|---|---|---|
| 2019/0223610 | A1* | 7/2019 | Huai | A47C 19/12 |
| 2020/0054145 | A1* | 2/2020 | Shih | A47C 20/10 |
| 2020/0100961 | A1* | 4/2020 | Zeng | A47C 19/021 |
| 2020/0178695 | A1* | 6/2020 | Shih | A47C 20/048 |
| 2021/0186223 | A1* | 6/2021 | Zeng | A47C 17/18 |

* cited by examiner

ELECTRIC BED

TECHNICAL FIELD

The present invention relates to the technical field of electric beds, in particular to an electric bed.

BACKGROUND

The electric bed is a bed frame that can electrically control the height of the head or the foot of the bed plate, and can freely adjust the bending degree of the bed plate. The electric bed is classified into two types: the bed frame type and the bed plate type. The bed frame type is referred to as a European electric bed, and the bed plate type is referred to as an American electric bed. Vibration or music functions may be configured as needed, and the electric bed can now be connected to mobile devices for remote control, which is common in home or healthcare.

At present, the more common electric bed utilizes the effect of storing and unfolding the bed plate, and has the functions of changing a bed and changing a chair. Although the electric bed can meet the use of different requirements to a certain extent, the following defects still exist.

(1) After the electric bed is changed from a chair to a bed, the bed plate at the tail end has the effect of folding and unfolding so that only one end is connected with the bed frame, and the other end is in a suspended state. At this time, the overall center of gravity of the electric bed with a changed bed is biased to the rear end. When the bed is stepped on from the bed plate at the tail end, the overall center of gravity of the electric bed is unstable, and the front end thereof is easily upwarped.

(2) After the electric bed is changed from a bed to a chair, the overall size is relatively fixed, and for different users, the height is different. It is difficult for the back of the user with a shorter height to effectively contact with the backing plate 60 of the electric bed which is changed to a chair. There is a lack of support at the waist and the applicability is poor.

(3) When used by the elderly or those with limited mobility, the electric bed is the same as the common bed, and it is inconvenient for the user to get up, which limits the applicability of the electric bed.

SUMMARY

The object of the present invention is to provide an electric bed, which solves the technical problem that the stability of the center of gravity of the prior electric bed is poor and the applicability is poor.

In order to achieve the above object, the main technical solutions adopted by the present invention comprise:

An electric bed comprising a main bed frame, wherein: a movable auxiliary bed frame connected to the main bed frame through a sliding mechanism, the auxiliary bed frame is sequentially provided with a bottom plate, a base plate and a backing plate, the front end of the base plate is rotatably connected to the front end of the auxiliary bed frame, the rear end of the bottom plate is rotatably connected to the front end of the base plate, the front end of the backing plate is rotatably connected to the rear end of the base plate, a first electric telescopic rod and a second electric telescopic rod for driving the bottom plate and the backing plate to be unfolded and stored are provided between the bottom plate and the main bed frame and between the backing plate and the auxiliary bed frame, respectively, and a linkage member is provided between the bottom plate and the main bed frame for driving the auxiliary bed frame and the bottom plate, the base plate and the backing plate to move to the rear side of the main bed frame as a whole when the bottom plate is unfolded.

Preferably, the length of the bottom plate is smaller than the height of the auxiliary bed frame, and when the bottom plate is in the storage state, the bottom plate is perpendicular to the plane of the main bed frame.

Preferably, the sliding mechanism comprises wheel grooves symmetrically provided on both sides of the main bed frame, the wheel grooves are provided with pulleys, and the two pulleys are both fixedly mounted to the front ends of both sides of the auxiliary bed frame by a wheel frame.

Preferably, the linkage member comprises a guiding block fixedly mounted to the front end of the main bed frame, the guiding block is provided with a guiding groove in a vertical state, and a linkage block having an end rotatable and movable within the guiding groove is provided between the guiding groove and the bottom surface of the bottom plate.

Preferably, the linkage block comprises a columnar rotating rod having an outer diameter matching the width of the guiding groove, and both ends of the rotating rod are fixedly connected with a supporting plate having an end fixedly connected to the bottom surface of the bottom plate.

Preferably, the pushing end of the first electric telescopic rod is rotatably sleeved on the rotating rod;

the pushing end of the second electric telescopic rod is connected with the backing plate through a stopper, the stopper is fixedly connected with the backing plate, and the stopper is rotatably connected with the pushing end of the second electric telescopic rod;

the fixed ends of the first electric telescopic rod and the second electric telescopic rod are both connected with the main bed frame and the auxiliary bed frame through a first connecting block, one ends of two of the first connecting blocks are fixedly connected with the main bed frame and the auxiliary bed frame, respectively, and the other ends of two of the first connecting blocks are rotatably connected with the fixed end of the first electric telescopic rod and the fixed end of the second electric telescopic rod, respectively.

Preferably, a U iron is fixedly mounted at the rear end of the base plate, and the stopper penetrates through the U iron;

the closed end of the U iron is provided with a threaded hole, and the internal thread of the threaded hole is connected with an adjusting bolt penetrating through the closed end.

Preferably, the backing plate comprises a bracket, the bracket is rotatably connected to the rear end of the base plate, and the bracket is connected to a swingable backing plate by a connecting rod;

a third electric telescopic rod is provided between the bracket and the backing plate, both ends of the third electric telescopic rod are connected with the bracket and the backing plate through a second connecting block, respectively, both ends of the third electric telescopic rod are rotatably connected with two of the second connecting blocks, respectively, and two of second connecting blocks are fixedly connected with the bracket and the backing plate, respectively.

Preferably, the rear end of the stopper is fixedly mounted on the surface of the bracket.

Preferably, the lower surface of the main bed frame is provided with a bed leg.

The present invention has at least the following beneficial effects.

The first electric telescopic rod and the second electric telescopic rod drive the bottom plate and the backing plate to be in the unfolded and stored state, so that the electric bed can be switched between the bed and the chair. The function is stronger and it is more convenient to use.

The second electric telescopic rod continues to operate after the backing plate is unfolded. After the pushing end of the second electric telescopic rod drives the stopper to be in contact with the end of an adjusting bolt, the backing plate cannot continue to rotate. At this time, the second electric telescopic rod will drive the entire backing plate and the base plate to swing upward with the connection point between the front end of the base plate and the auxiliary bed frame as an axis. At this time, the electric bed can lift up the human body, and has the effect of helping get up. By providing a linkage member, in the process that the first electric telescopic rod drives the bottom plate to be unfolded, the linkage block rotates while moving upward in the guiding groove. The bottom plate will push the base plate, the backing plate and the auxiliary bed frame to move backward on the main bed frame through a sliding mechanism while rotating to be unfolded, so that the center of gravity of the bottom plate moves backwards after being unfolded. The electric bed is more stable, the function is stronger and it is more convenient to use.

The third electric telescopic rod and the backing plate are swingably connected to the bracket by a connecting rod. After the third electric telescopic rod is operated, the third motor will drive the backing plate to swing through the swing of a strut. The backing plate is unfolded and stored. When being unfolded and stored, the backing plate will move forward and backward along the length direction of the main bed frame. Further, according to the height of different human bodies, after the human body sits on the electric bed which has changed to a chair, the position of the backing plate is adjusted, so that the backing plate always effectively supports the human body. The function is stronger and it is more convenient to use.

DESCRIPTION OF REFERENCE SIGNS

Figure 1:
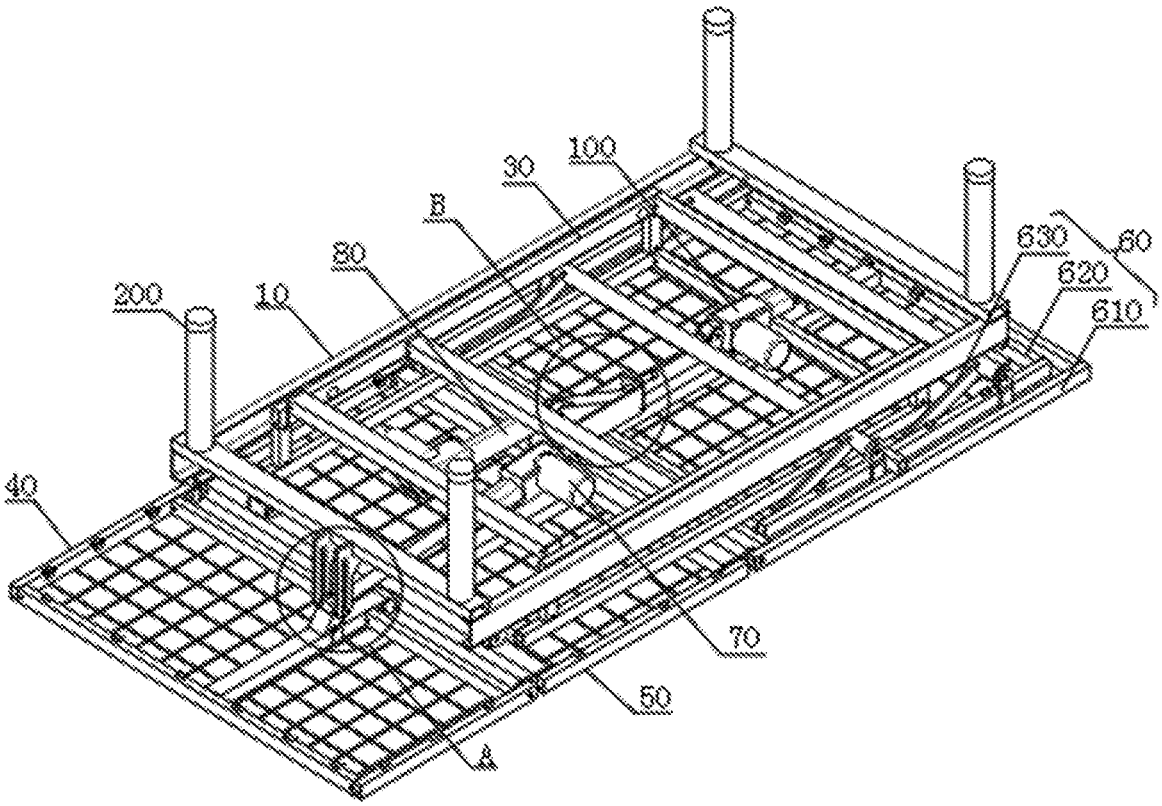
FIG. 1 is a schematic structural diagram of the present invention.

In the figures: 10: a main bed frame; 20: a sliding mechanism; 210: a wheel groove; 220: a pulley; 30: an auxiliary bed frame; 40: a bottom plate; 50: a base plate; 60: a backing plate; 610: a bracket; 620: a backing plate; 630: a connecting rod; 70: a first electric telescopic rod; 80: a second electric telescopic rod; 90: a linkage member, 910: a guiding block; 920: a guiding groove; 930: a linkage block; 931: a rotating rod; 932: a supporting plate; 100: a third electric telescopic rod; 200: a bed leg; 300: a U iron; 400: a stopper; 500: a threaded hole; 600: an adjusting bolt; 700: a first connecting block; 800: a second connecting block.

DESCRIPTION OF THE EMBODIMENTS

The technical solutions in the embodiments of the present invention will be clearly and completely described hereinafter with reference to the accompanying drawings in the embodiments of the present invention. It is obvious that the described embodiments are merely a part of the embodiments of the present invention, rather than all embodiments. All other embodiments obtained by those skilled in the art based on the embodiments of the present invention without creative efforts fall within the scope of the present invention.

Referring to FIGS. 1-7, the present embodiment provides an electric bed comprising a main bed frame 10, wherein the lower surface of the main bed frame 10 is provided with a bed leg 200, a movable auxiliary bed frame 30 is connected to the main bed frame 10 through a sliding mechanism, the auxiliary bed frame 30 is sequentially provided with a bottom plate 40, a base plate 50 and a backing plate 60, the front end of the base plate 50 is rotatably connected to the front end of the auxiliary bed frame 30, the rear end of the bottom plate 40 rotatably is connected to the front end of the base plate 50, the front end of the backing plate 60 is rotatably connected to the rear end of the base plate 50, a first electric telescopic rod 70 and a second electric telescopic rod 80 for driving the bottom plate 40 and the backing plate 60 to be unfolded and stored are provided between the bottom plate 40 and the main bed frame 10 and between the backing plate 60 and the auxiliary bed frame 30, respectively, and a linkage member 90 is provided between the bottom plate 40 and the main bed frame 10 for driving the auxiliary bed frame 30 and the bottom plate 40, the base plate 50 and the backing plate 60 to move to the rear side of the main bed frame 10 as a whole when the bottom plate 40 is unfolded.

Figure 2:
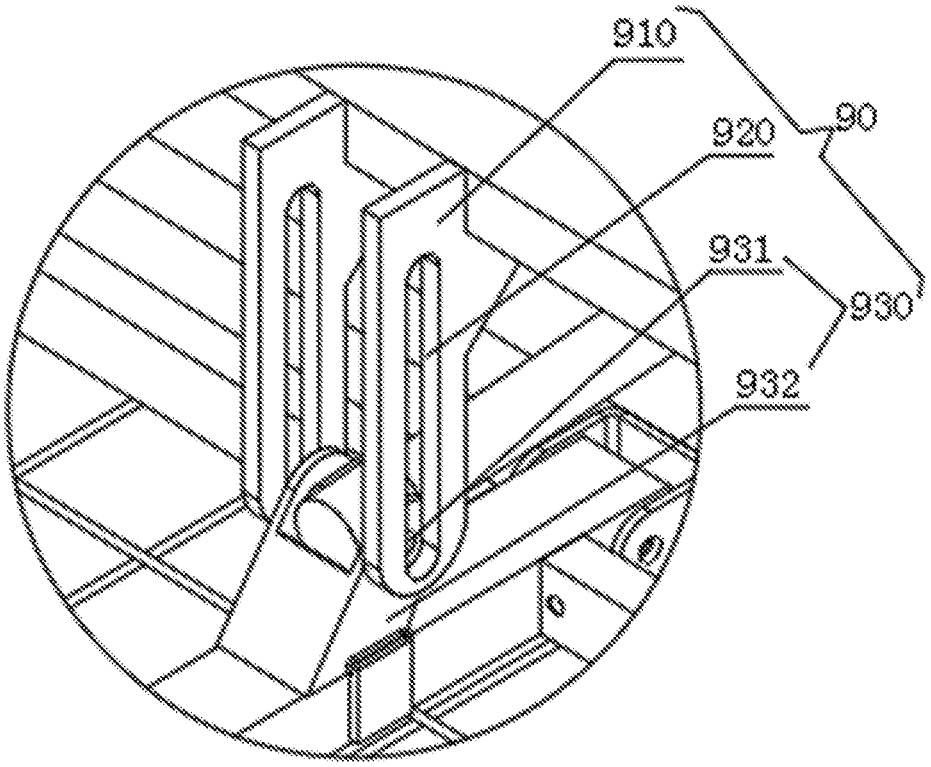
FIG. 2 is an enlarged diagram of A in FIG. 1.

Referring to FIG. 2, as one option of the above embodiments, the linkage member 90 comprises a guiding block 910 fixedly mounted to the front end of the main bed frame 10, the guiding block 910 is provided with a guiding groove 920 in a vertical state, and a linkage block 930 having an end rotatable and movable within the guiding groove 920 is provided between the guiding groove 920 and the bottom surface of the bottom plate 40. The linkage block 930 comprises a columnar rotating rod 931 having an outer diameter matching the width of the guiding groove 920, and both ends of the rotating rod 931 are fixedly connected with a supporting plate 932 having an end fixedly connected to the bottom surface of the bottom plate 40. In the process that the first electric telescopic rod 70 drives the bottom plate 40 to be unfolded, the linkage block 930 moves inward in the guiding groove 920. The bottom plate 40 will push the base plate 50, the backing plate 60 and the auxiliary bed frame 30 to move backward on the main bed frame 10 through a sliding mechanism 20 as whole while rotating to be unfolded, so that the center of gravity of the bottom plate 40 moves backwards after being unfolded. The electric bed is more stable, the function is stronger and it is more convenient to use.

Figure 6:
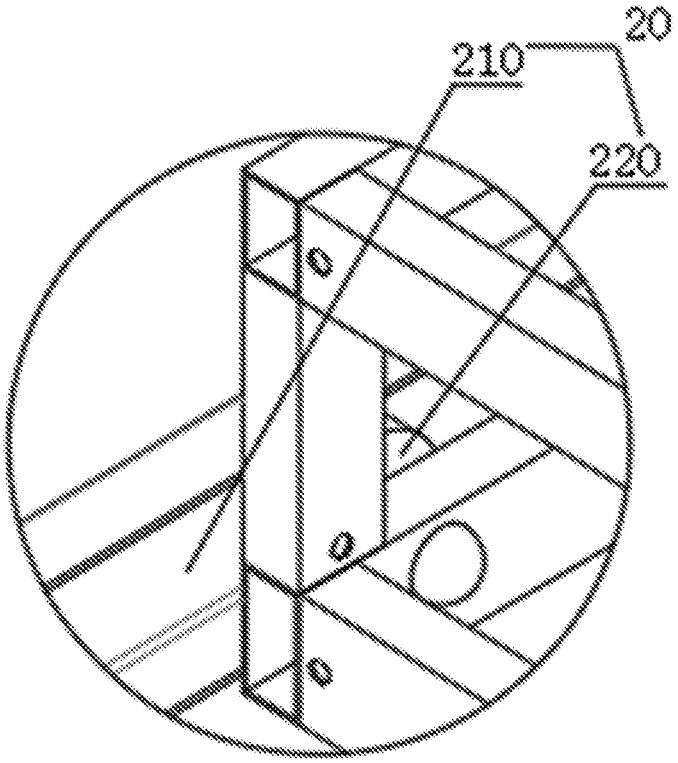
FIG. 6 is an enlarged diagram of C in FIG. 1.
Figure 7:
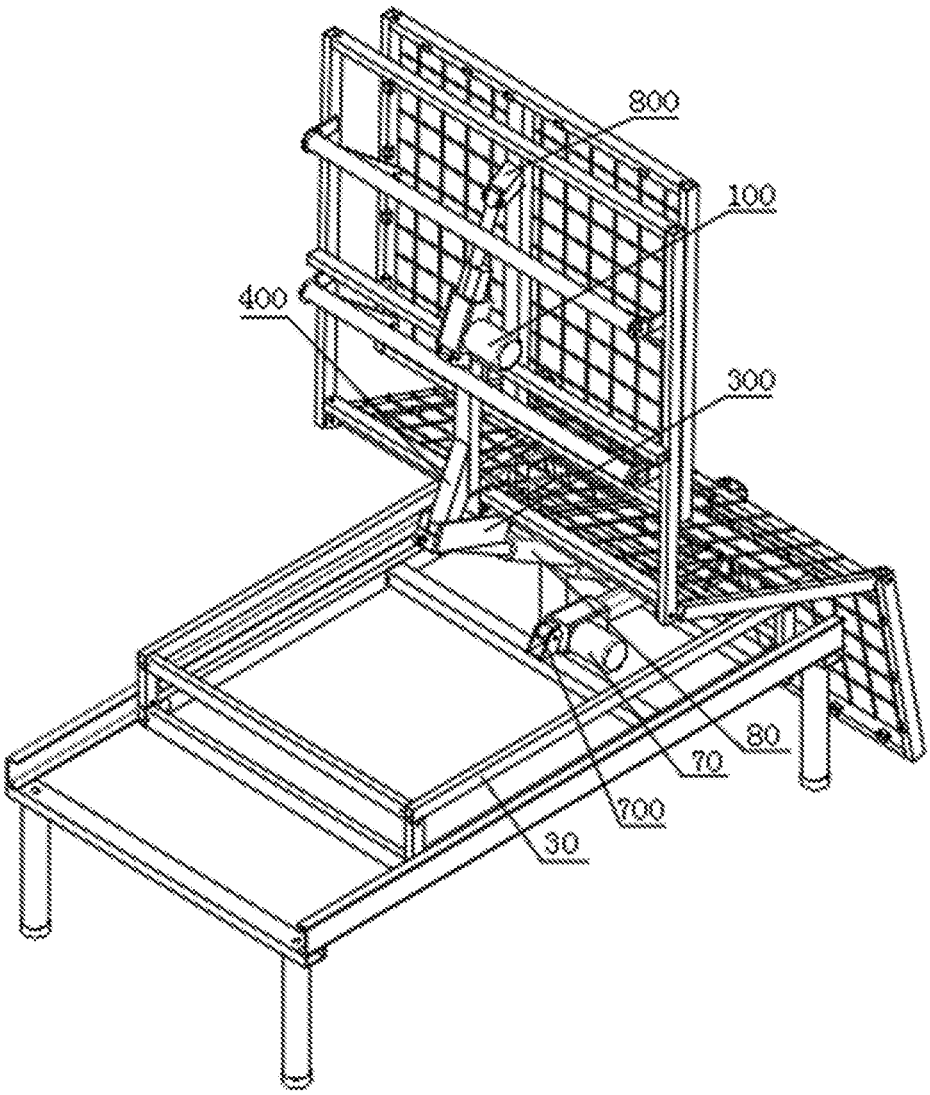
FIG. 7 is a schematic diagram of the present invention when helping get up.

Referring to FIG. 6, as one option of the above embodiments, the sliding mechanism 20 comprises wheel grooves 210 symmetrically provided on both sides of the main bed frame 10, the wheel grooves 210 are provided with pulleys 220, and the two pulleys 220 are both fixedly mounted to the front ends of both sides of the auxiliary bed frame 30 by a wheel frame. The pulleys 220 roll in the wheel grooves 210, so that the movement of the auxiliary bed frame 30 on the main bed frame 10 is more flexible. The wheel grooves 210 limit the pulleys 220 so that the movement of the auxiliary bed frame 30 is relatively stable.

Specifically, the pushing end of the first electric telescopic rod 70 is rotatably sleeved on the rotating rod; the pushing end of the second electric telescopic rod 80 is connected with the backing plate 60 through a stopper 400, the stopper 400 is fixedly connected with the backing plate 60, and the stopper 400 is rotatably connected with the pushing end of the second electric telescopic rod 80; the fixed ends of the first electric telescopic rod 70 and the second electric telescopic rod 80 are both connected with the main bed frame 10 and the auxiliary bed frame 30 through a first connecting block 700, one ends of two of the first connecting blocks 700 are fixedly connected with the main bed frame 10 and the auxiliary bed frame 30, respectively, and the other ends of two of the first connecting blocks 700 are rotatably connected with the fixed end of the first electric telescopic rod 70 and the fixed end of the second electric telescopic rod 80, respectively. When the first electric telescopic rod 70 pushes the backing plate 40 to be unfolded through the first connecting block 700, the fixed end of the first electric telescopic rod 70 rotates while the backing plate 40 makes a circular motion, and the pushing end of the first electric telescopic rod 70 has a process of moving upward, so that the first electric telescopic rod 70 is in a state that the pushing end inclines upward. With the continuous operation of the first electric telescopic rod 70, the first electric telescopic rod 70 has an upward inclined pushing force on the fist connecting block 700 on the backing plate 40. At this time, the rotating rod 931 rolls upward in the guiding groove 920. At the same time, the rear end of the backing plate 40 has a process of moving backward, thus driving the entire auxiliary bed frame 30 to move backward on the main bed frame 10. Secondly, after the second electric telescopic rod 80 operates, while the second electric telescopic rod 80 pushes the backing plate 60 to swing, the fixed end of the second electric telescopic rod 80 can rotate with the first connecting block 700 connected with the fixed end, and while the pushing end of the second electric telescopic rod 80 can rotate relative to the stopper 400 while pushing the backing plate 60 to swing.

In the above embodiment, the first electric telescopic rod 70 is activated to drive the bottom plate 40 to be unfolded, so that the bottom plate 40, the base plate 50 and the backing plate 60 have a horizontal plate-like structure as a whole, thereby realizing the function of the electric bed as a bed. At this time, the first electric telescopic rod 70 is activated to unfold and store the bottom plate 40, so that when the electric bed is used as a bed, the size of the electric bed can be changed. Especially in the process that the bottom plate 40 is unfolded, the auxiliary bed frame 30 can move backward on the main bed frame 10 through the sliding mechanism 20. The linkage member 90 can provide a driving force for the movement of the auxiliary bed frame 30 during the unfolding process, so that when the bottom plate 40 is unfolded, the auxiliary bed frame 30 moves backward on the main bed frame 10 as a whole along with the bottom plate 40, the base plate 50 and the backing plate 60, so that the overall center of gravity moves backward, and the bed body is more stable.

In the above embodiment, the length of the bottom plate 40 is smaller than the height of the auxiliary bed frame 30, and when the bottom plate 40 is in the storage state, the bottom plate 40 is perpendicular to the plane of the main bed frame 10, so that when the bottom plate 40 is in the storage state, the whole electric bed is relatively regular and the appearance is relatively flat.

Figure 3:
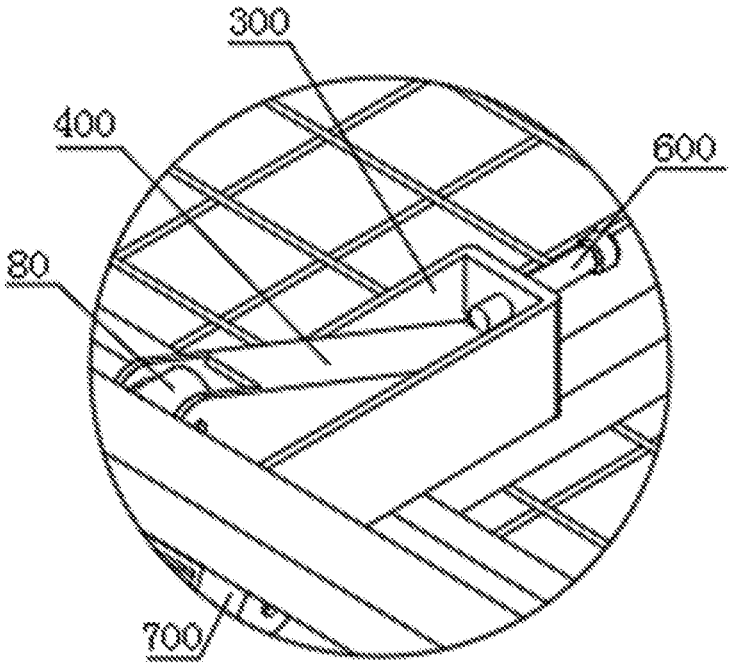
FIG. 3 is an enlarged diagram of B in FIG. 1.
Figure 4:
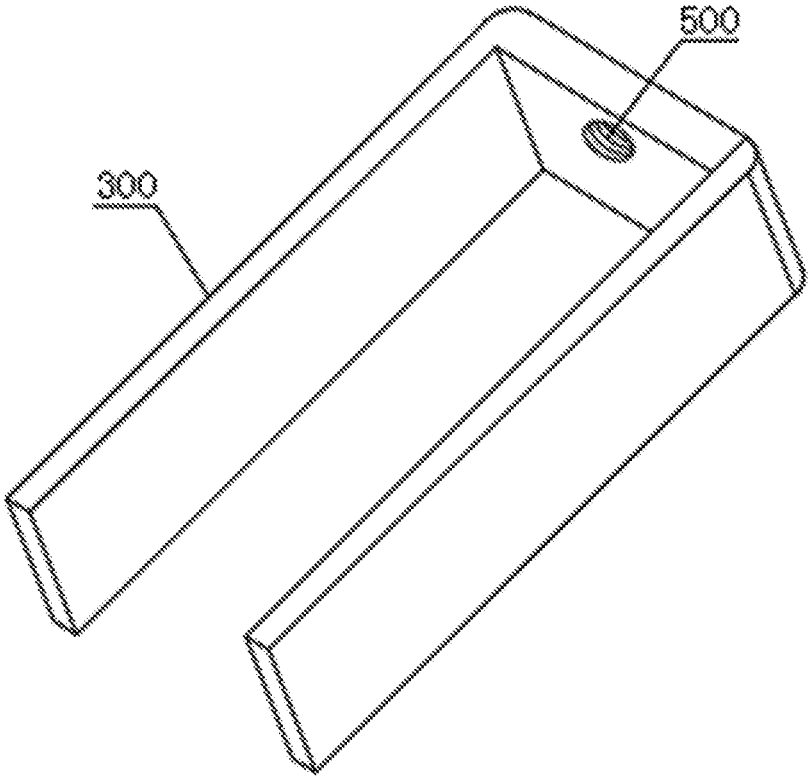
FIG. 4 is a schematic diagram of the U iron of the present invention.
Figure 5:
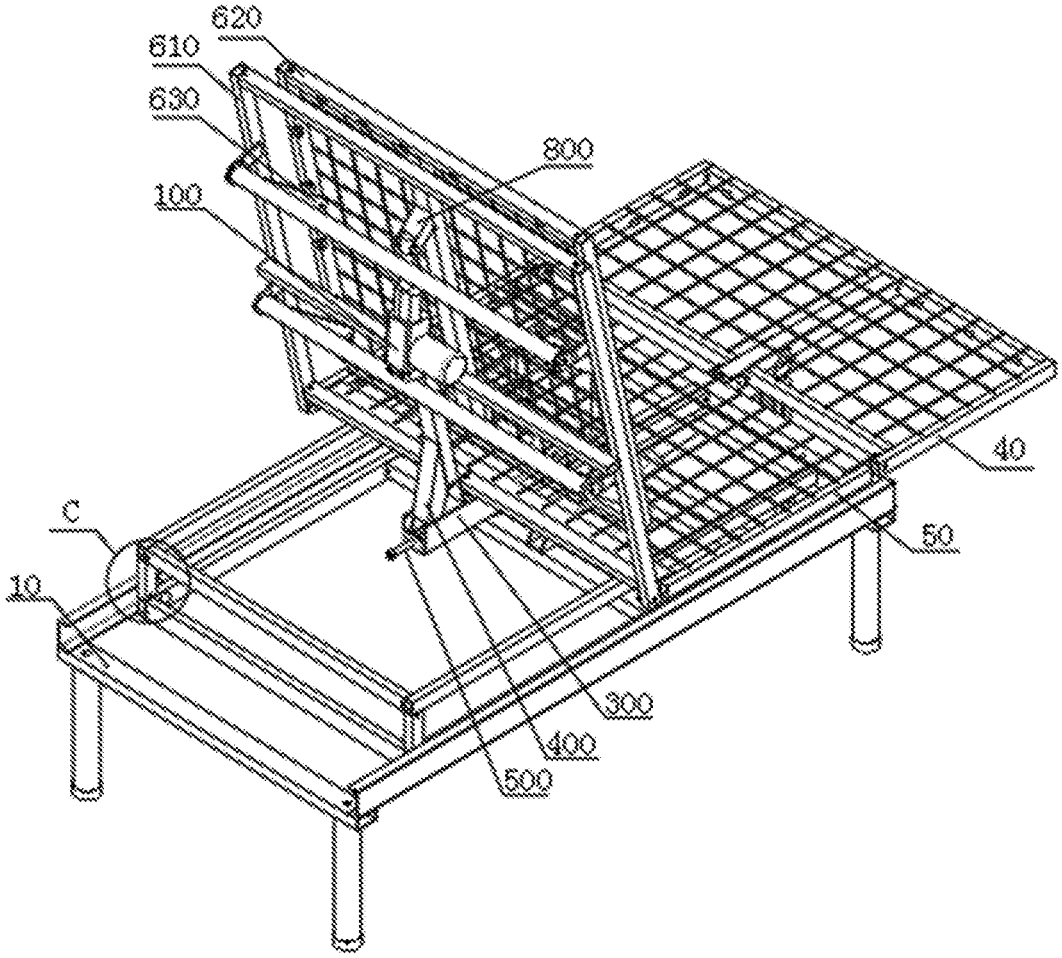
FIG. 5 is a schematic diagram when the backing plate is unfolded in the side chair state of the present invention.

Referring to FIGS. 1, 3 and 5, a U iron 300 is fixedly mounted at the rear end of the base plate 50, and the stopper 400 penetrates through the U iron 300; the closed end of the U iron 300 is provided with a threaded hole 500, and the internal thread of the threaded hole 500 is connected with an adjusting bolt 600 penetrating through the closed end. After the stopper 400 rotates by a certain amplitude, the front end of the stopper 400 moves out of the U iron 300, and the adjusting bolt 600 is abutted against one side surface of the stopper 400. After the second electric telescopic rod 80 is activated to move, the second electric telescopic rod 80 will drive the backing plate 60 to rotate relative to the base plate 50. At this time, the stopper 400 will rotate in the U iron 300, and the front end of the stopper 400 will rotate out of the U iron 300 and approach the end of the adjusting bolt 600. Before the stopper 400 is in contact with the end of the adjusting bolt 600, the electric bed can be adjusted by adjusting the swing amplitude of the backing plate 60, and switch the electric bed between a bed and a chair, so that the electric bed is more stronger in flexibility and wider in applicability. After the stopper 400 is in contact with the end of the adjusting bolt 600, the backing plate 60 cannot continue to rotate. At this time, the second electric telescopic rod 80 will drive the entire backing plate 60 and the base plate 50 to swing upward with the connection point between the front end of the base plate 50 and the auxiliary bed frame 30 as an axis. At this time, the electric bed can lift up the human body, and has the effect of helping get up. The function is of practical significance for the elderly with mobility disabilities or patients with diseases, and is worth promoting. In addition, the adjusting bolt 600 is rotated so that the free swing amplitude of the stopper 400 in the U iron 300 can be adjusted by adjusting the depth of insertion of the adjusting bolt 600 into the U iron 300, thus the free swing amplitude of the backing plate 60 can be adjusted.

Specifically, the backing plate 60 comprises a bracket 610, wherein the rear end of the stopper 400 is fixedly mounted on the surface of the bracket 610, the bracket 610 is rotatably connected to the rear end of the base plate 50, and the bracket 610 is connected to a swingable backing plate 620 by a connecting rod 630, wherein a third electric telescopic rod 100 is provided between the bracket 610 and the backing plate 620, both ends of the third electric telescopic rod 100 are connected with the bracket 610 and the backing plate 620 through a second connecting block 800, respectively, both ends of the third electric telescopic rod 100 are rotatably connected with two of the second connecting blocks 800, respectively, and two of second connecting blocks 800 are fixedly connected with the bracket 610 and the backing plate 620, respectively, for driving the backing plate 620 to swing and be unfolded and stored on the bracket 610.

The third electric telescopic rod 100 and the backing plate 620 are swingably connected to the bracket 610 by a connecting rod 630. After the third electric telescopic rod 100 is operated, the third motor 100 will drive the backing plate 620 to swing through the swing of a strut. The backing plate 620 is unfolded and stored. When being unfolded and stored, the backing plate 620 will move forward and backward along the length direction of the main bed frame 10. Further, according to the height of different human bodies, after the human body sits on the electric bed which has changed to a chair, the position of the backing plate 620 is adjusted, so that the backing plate 620 always effectively supports the human body. The function is stronger and it is more convenient to use.

Although the embodiments of the present invention have been shown and described, it will be understood by those skilled in the art that various changes, modifications, substitutions and variations can be made to these embodiments without departing from the principle and spirit of the present invention. The scope of the present invention is defined by the appended claims and their equivalents.

What is claimed is:

1. An electric bed, comprising a main bed frame and a movable auxiliary bed frame, wherein: a movable auxiliary bed frame is connected to the main bed frame via a sliding mechanism, the auxiliary bed frame is sequentially provided with a bottom plate, a base plate and a backing plate, a front end of the base plate is rotatably connected to a front end of the auxiliary bed frame, a rear end of the bottom plate is rotatably connected to a front end of the base plate, a front end of the backing plate is rotatably connected to a rear end of the base plate, a first electric telescopic rod for driving the bottom plate to move to an unfolded/folded state is provided between the bottom plate and the main bed frame, a second electric telescopic rod for driving the backing plate to move to an unfolded/folded state is provided between the backing plate and the auxiliary bed frame, and a linkage member is provided between the bottom plate and the main bed frame for driving the bottom plate to move to the unfolded state, and along with moving of the bottom plate to the unfolded state, the bottom plate brings the auxiliary bed frame, the bottom plate, the base plate and the backing plate as a whole to move to a rear side of the main bed frame, a length of the bottom plate along a direction away from the base plate is smaller than a height of the auxiliary bed frame, the height of the auxiliary bed is a distance from a top side where the bottom plate is arranged to a supporting surface where the electric bed is supported, and when the bottom plate is in the storage state, the bottom plate is perpendicular to the plane of the main bed frame.

2. The electric bed according to claim 1, wherein the sliding mechanism comprises wheel grooves symmetrically provided on both sides of the main bed frame, the wheel grooves are provided with pulleys, and the two pulleys are both fixedly mounted to the front ends of both sides of the auxiliary bed frame by a wheel frame.

3. The electric bed according to claim 1, wherein the linkage member comprises a guiding block fixedly mounted to the front end of the main bed frame, the guiding block is provided with a guiding groove in a vertical state, and a linkage block having an end rotatable and movable within the guiding groove is provided between the guiding groove and the bottom surface of the bottom plate.

4. The electric bed according to claim 3, wherein the linkage block comprises a columnar rotating rod having an outer diameter matching the width of the guiding groove, and both ends of the rotating rod are fixedly connected with a supporting plate having an end fixedly connected to the bottom surface of the bottom plate.

5. The electric bed according to claim 4, wherein: a pushing end of the first electric telescopic rod is rotatably sleeved on the rotating rod; a pushing end of the second electric telescopic rod is connected with the backing plate through a stopper, the stopper is fixedly connected with the backing plate, and the stopper is rotatably connected with the pushing end of the second electric telescopic rod; fixed ends of the first electric telescopic rod and the second electric telescopic rod are connected with the main bed frame and the auxiliary bed frame via two first connecting blocks respectively, one ends of the two first connecting blocks are fixedly connected with the main bed frame and the auxiliary bed frame respectively, and the other ends of the two first connecting blocks are rotatably connected with the fixed end of the first electric telescopic rod and the fixed end of the second electric telescopic rod, respectively.

6. The electric bed according to claim 5, wherein: a U iron is fixedly mounted at the rear end of the base plate, and the stopper penetrates through the U iron; the closed end of the U iron is provided with a threaded hole, and the internal thread of the threaded hole is connected with an adjusting bolt penetrating through the closed end.

7. The electric bed according to claim 1, wherein the backing plate comprises a bracket, the bracket is rotatably connected to the rear end of the base plate, and the bracket is connected to a swingable backing plate by a connecting rod; a third electric telescopic rod is provided between the bracket and the backing plate, both ends of the third electric telescopic rod are connected with the bracket and the backing plate via two second connecting blocks respectively, both ends of the third electric telescopic rod are rotatably connected with one ends of the two second connecting blocks respectively, and the other ends of the two second connecting blocks are fixedly connected with the bracket and the backing plate respectively.

8. The electric bed according to claim 5, wherein a rear end of the stopper is fixedly mounted on the surface of the bracket.

9. The electric bed according to claim 1, wherein a lower surface of the main bed frame is provided with a bed leg.

* * * * *